US009066588B1

(12) United States Patent
Kumar

(10) Patent No.: US 9,066,588 B1
(45) Date of Patent: Jun. 30, 2015

(54) MULTI-FUNCTIONAL, RECONFIGURABLE FURNITURE SYSTEM

(71) Applicant: Sivathanu B. Kumar, Tampa, FL (US)

(72) Inventor: Sivathanu B. Kumar, Tampa, FL (US)

( * ) Notice: Subject to any disclaimer, the term of this patent is extended or adjusted under 35 U.S.C. 154(b) by 0 days.

(21) Appl. No.: 14/457,736

(22) Filed: Aug. 12, 2014

Related U.S. Application Data

(63) Continuation-in-part of application No. 13/534,443, filed on Jun. 27, 2012, now Pat. No. 8,832,873, which is a continuation-in-part of application No. 12/802,086, filed on May 28, 2010, now Pat. No. 8,407,830.

(60) Provisional application No. 61/217,613, filed on Jun. 2, 2009, provisional application No. 61/404,151, filed on Sep. 28, 2010, provisional application No. 61/402,963, filed on Sep. 8, 2010.

(51) Int. Cl.

| | |
|---|---|
| ***A47B 85/00*** | (2006.01) |
| ***A47B 43/00*** | (2006.01) |
| ***A47B 85/06*** | (2006.01) |
| ***A47B 47/00*** | (2006.01) |
| ***A47C 27/08*** | (2006.01) |
| ***A47C 27/00*** | (2006.01) |
| ***A47C 19/20*** | (2006.01) |
| ***A47C 17/52*** | (2006.01) |

(52) U.S. Cl.
CPC ..... *A47B 85/00* (2013.01); *A47B 43/00* (2013.01); *A47B 85/06* (2013.01); *A47B 47/0091* (2013.01); *A47C 27/081* (2013.01); *A47C 27/001* (2013.01); *A47C 19/205* (2013.01); *A47C 17/52* (2013.01)

(58) Field of Classification Search
CPC ..... A47C 17/52; A47C 17/60; A47C 17/62; A47C 19/22; A47C 17/58; A47D 7/007; A47B 85/00
USPC ..... 312/237, 240, 257.1, 235.2, 235.3, 312/235.4, 235.5, 313, 314, 315, 316, 312/317.1, 317.3; 5/2.1, 3, 5, 6, 7, 133, 5/136, 159.1, 160
See application file for complete search history.

(56) References Cited

U.S. PATENT DOCUMENTS

| | | | | | |
|---|---|---|---|---|---|
| 117,632 | A * | 8/1871 | Hopfs | 5/2.1 |
| 266,860 | A * | 10/1882 | Meissner | 5/164.1 |
| 3,088,127 | A * | 5/1963 | Eames | 5/2.1 |
| 3,858,253 | A * | 1/1975 | Lauzon | 5/2.1 |
| 4,793,011 | A * | 12/1988 | Eve | 5/136 |
| 4,866,798 | A * | 9/1989 | Harris | 5/263 |
| 5,152,593 | A * | 10/1992 | Domenig | 312/245 |
| 6,401,276 | B1 * | 6/2002 | Sherman | 5/136 |
| 2002/0133882 | A1 * | 9/2002 | Chapman et al. | 5/713 |
| 2003/0070224 | A1 * | 4/2003 | Walsh | 5/2.1 |
| 2006/0107456 | A1 * | 5/2006 | Joseph | 5/2.1 |

* cited by examiner

*Primary Examiner* — James O Hansen

(57) ABSTRACT

A selection of inter-changeable box-shaped modular units is comprised of a plurality of combination shelving assemblies and box-shaped shelving assemblies. A cabinet has an upper plate and a parallel lower plate, a left side plate and a right side plate, and an intermediate plate providing a right and a left central opening. The right central opening engages a selection of a user's choice of inter-changeable box-shaped modular units comprised of shelving assemblies and box-shaped shelving assemblies. The left central opening provides housing including housing for an associated mattress. The cabinet is movable between horizontal and vertical orientations. In the horizontal orientation the repositionable support panels of the cabinet provide support for a mattress. In the vertical orientation the cabinet includes a desk and a computer work station.

5 Claims, 20 Drawing Sheets

MULTI-FUNCTIONAL, RECONFIGURABLE FURNITURE SYSTEM

RELATED APPLICATIONS

This non-provisional application is a continuation-in-part of pending application Ser. No. 13/534,443 filed Jun. 27, 2012 which is, in turn, a continuation-in-part of application Ser. No. 12/802,086 filed May 28, 2010 issued Apr. 2, 2013 as U.S. Pat. No. 8,407,830, which is, in turn, based upon Provisional Application No. 61/217,613 filed Jun. 2, 2009 and which claims the benefit of Provisional Application No. 61/404,151 filed Sep. 28, 2010 and Provisional Application No. 61/402,963 filed Sep. 8, 2010.

BACKGROUND OF THE INVENTION

Field of the Invention

The present invention relates to a multi-functional, reconfigurable furniture system and more particularly pertains to a furniture system convertible from an attractive cabinet including a desk and computer work station when needed and alternatively converted to a bed upon necessity.

DESCRIPTION OF THE PRIOR ART

The use of reconfigurable furniture systems of known designs and configurations is known in the prior art. More specifically, reconfigurable furniture systems of known designs and configurations previously devised and utilized for the purpose of conversion from a cabinet to a bed are known to consist basically of familiar, expected, and obvious structural configurations, not withstanding the myriad of designs encompassed by the crowded prior art which has been developed for the fulfillment of countless objectives and requirements.

While the prior art devices fulfill their respective, particular objectives and requirements, they do not describe a multi-functional, reconfigurable furniture system that can be converted to a cabinet including a desk and computer work station when needed and alternatively converted to a bed upon necessity.

In this respect, the multi-functional, reconfigurable furniture system according to the present invention substantially departs from the conventional concepts and designs of the prior art, and in doing so provides an apparatus primarily developed for the purpose being converted to a cabinet including a desk and computer work station when needed and alternatively converted to a bed upon necessity.

Therefore, it can be appreciated that there exists a continuing need for a new and improved multi-functional, reconfigurable furniture system which can be converted to a cabinet including a desk and computer work station when needed and alternatively converted to a bed upon necessity. In this regard, the present invention substantially fulfills this need.

SUMMARY OF THE INVENTION

In view of the foregoing disadvantages inherent in the known types of reconfigurable furniture systems of known designs and configurations now present in the prior art, the present invention provides an improved multi-functional, reconfigurable furniture system. As such, the general purpose of the present invention, which will be described subsequently in greater detail, is to provide a new and improved multi-functional, reconfigurable furniture system and method which has all the advantages of the prior art and none of the disadvantages.

To attain this, the present invention essentially comprises a multi-functional, reconfigurable furniture system for conversion to a cabinet including a desk and computer work station during the day and to a bed upon necessity. From a broad concept, the system includes a selection of a plurality of combination box-shaped modular units comprising shelving assemblies and box-shaped shelving assemblies, a cabinet movable between a horizontal and vertical orientation, a plurality of resilient mattress members, and similarly configured support panels coupled to the cabinet.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved multi-functional, reconfigurable furniture system which has all of the advantages of the prior art reconfigurable furniture systems of known designs and configurations and none of the disadvantages.

It is another object of the present invention to provide a new and improved multi-functional, reconfigurable furniture system which may be easily and efficiently manufactured and marketed.

It is further object of the present invention to provide a new and improved multi-functional, reconfigurable furniture system which is of durable and reliable constructions.

An even further object of the present invention is to provide a new and improved multi-functional, reconfigurable furniture system which is susceptible of a low cost of manufacture with regard to both materials and labor, and which accordingly is then susceptible of low prices of sale to the consuming public, thereby making such multi-functional, reconfigurable furniture system economically available to the buying public.

An even further object of the present invention is that the components of this system are adapted to be reconfigured and repositioned to provide various functionalities and utilities including at least functioning as a cabinet for storage and display, a book shelf, a desk, a computer work station and a bed with a mattress and further designing the inter-changeable box-shaped modular units and further the components of the inter-changeable box-shaped modular units as a modular component whereby the users are provided with the choice to select a preferred components, a plurality of components, a configuration of a combinations of components and also further allowing the users to replace or change the existing components at future time to meet their changing utility needs and preferences. Thus users are allowed to replace or change existing components and also add new components.

Lastly, it is an object of the present invention to provide a multi-functional, reconfigurable furniture system that can be converted to a cabinet including a desk and computer work station when needed and alternatively converted to a bed upon necessity.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
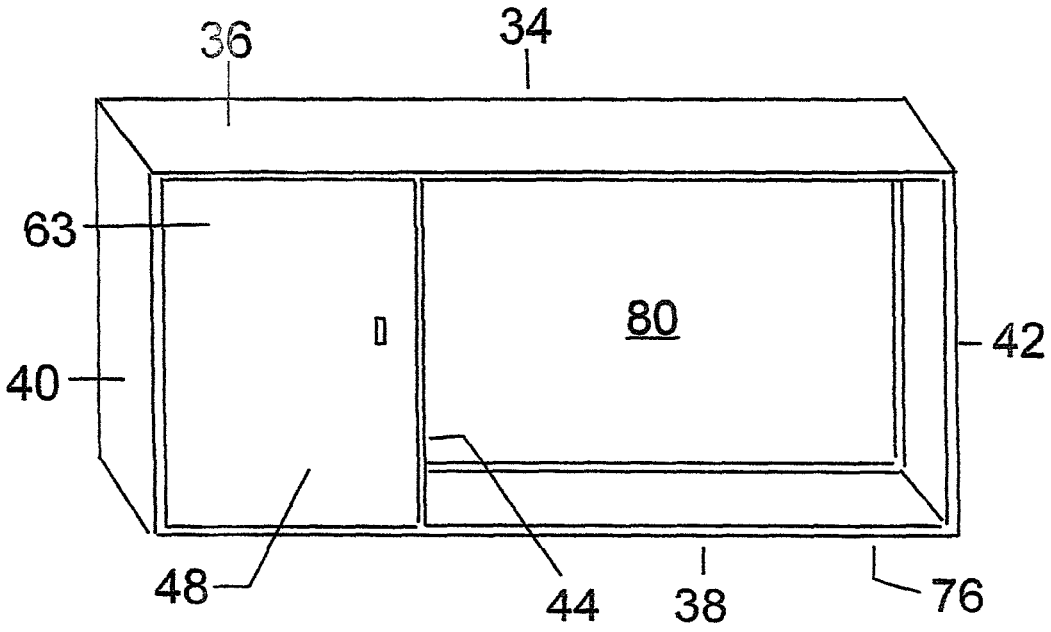
FIG. 1 is a perspective front view of a cabinet constructed in accordance with the principles of the present invention shown in a vertical orientation.
Figure 2:
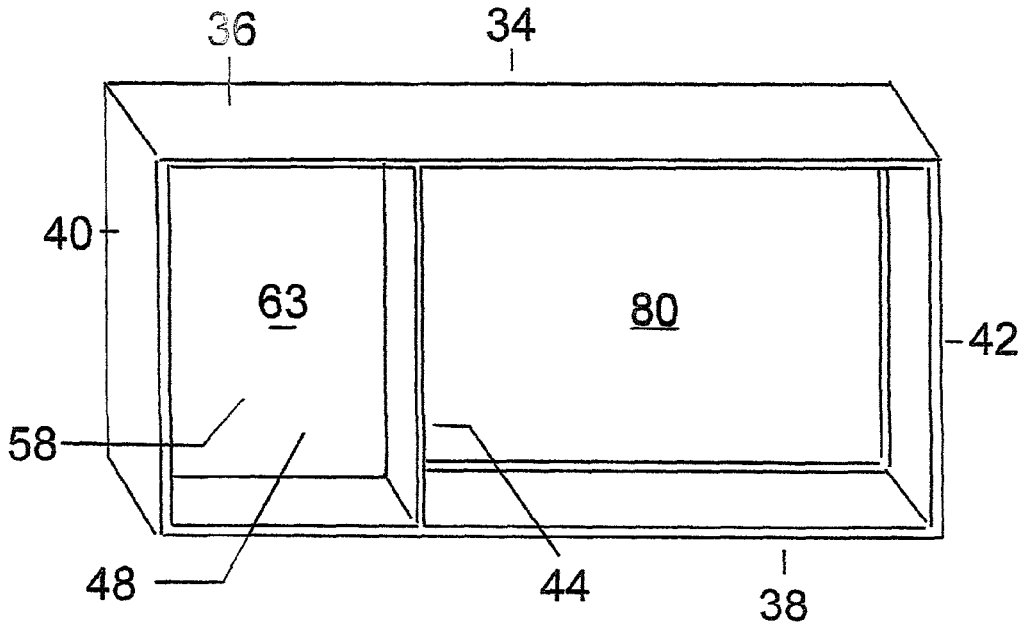
FIG. 2 is a perspective front view of the cabinet of FIG. 1 shown in vertical orientation and illustrating the left and right central openings.
Figure 3:
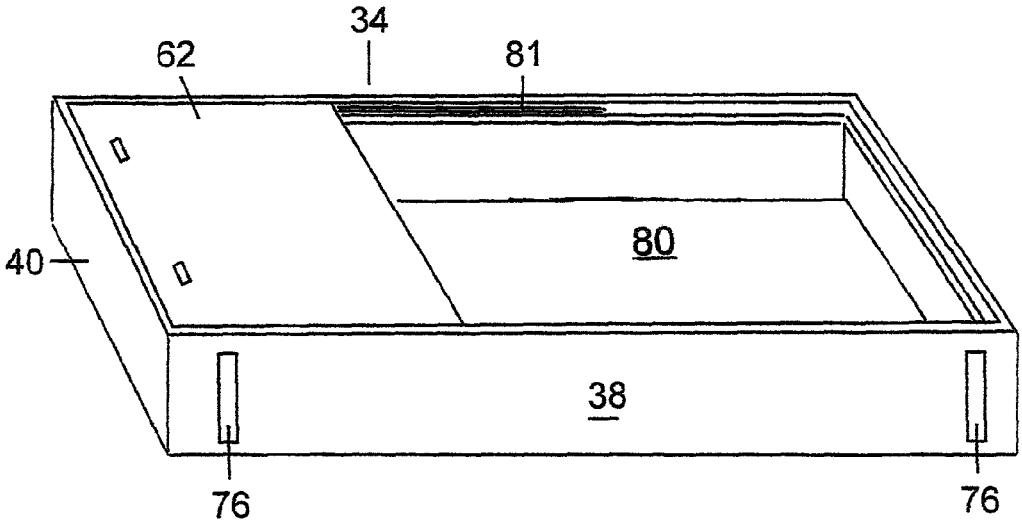
FIG. 3 is a perspective front view of the cabinet of the present invention shown in horizontal orientation.
Figure 4:
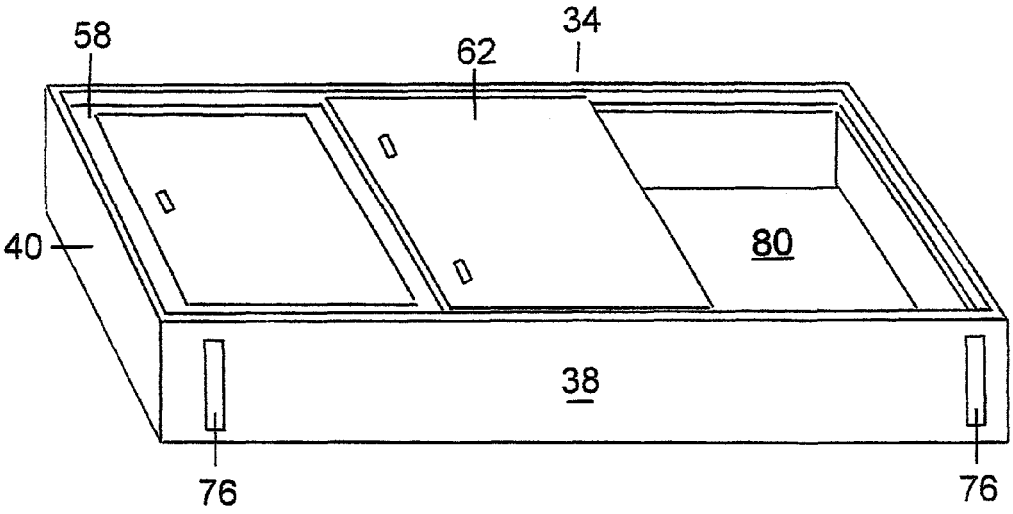
FIG. 4 is a perspective front view of the cabinet shown in FIG. 3, showing the middle support panel slidable in a second direction for re-positioning and spanning the openings.
Figure 5:
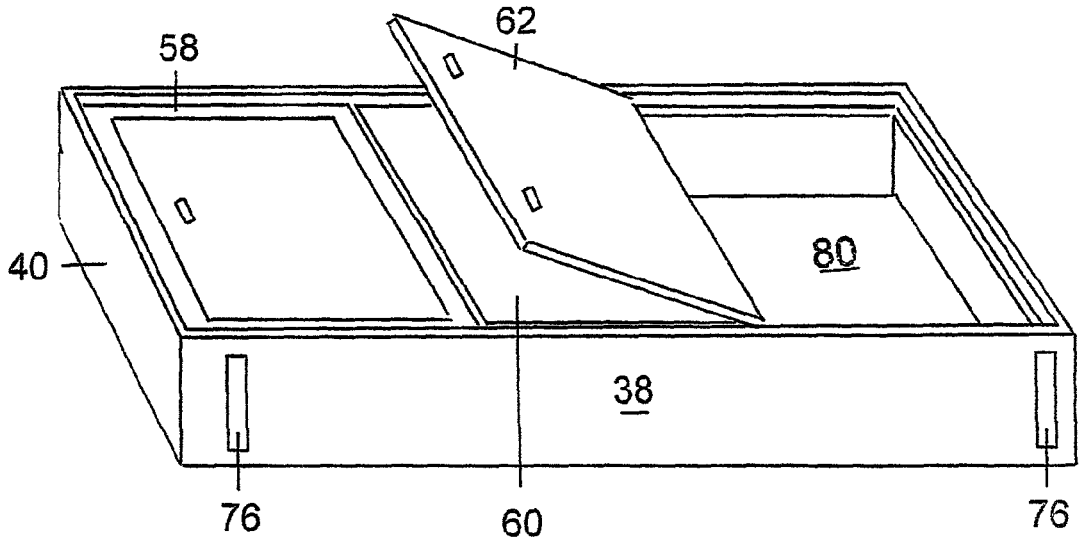
FIG. 5 is a perspective front view of the cabinet shown in FIGS. 3 and 4 shown in a horizontal orientation, showing the upper panels including hinges re-positionable for spanning the openings.
Figure 6:
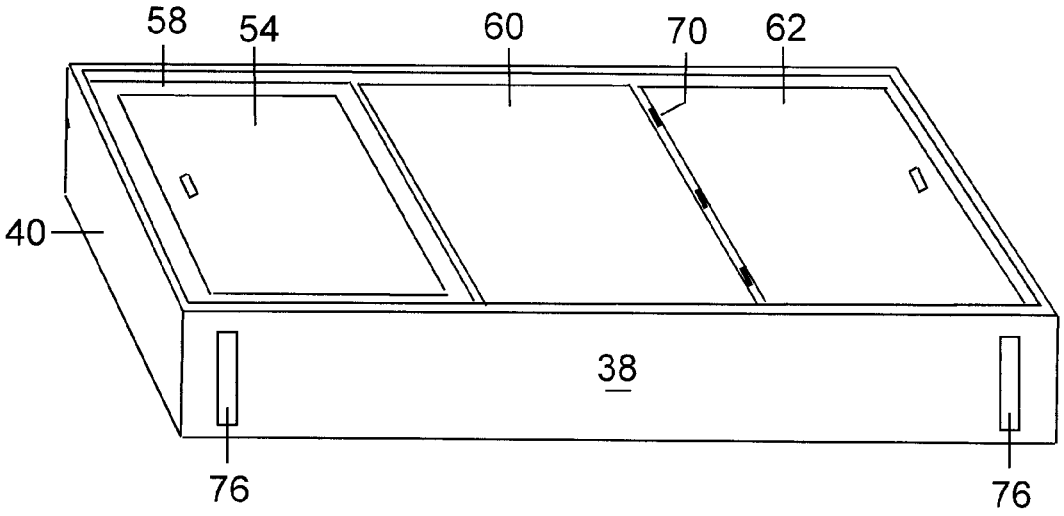
FIG. 6 is a perspective front view of the cabinet shown in FIGS. 3-5 shown in a horizontal orientation, showing the middle support panel slidable in a second direction for re-positioning and the panels including hinges re-positionable for spanning and covering the entire openings.
Figure 7:
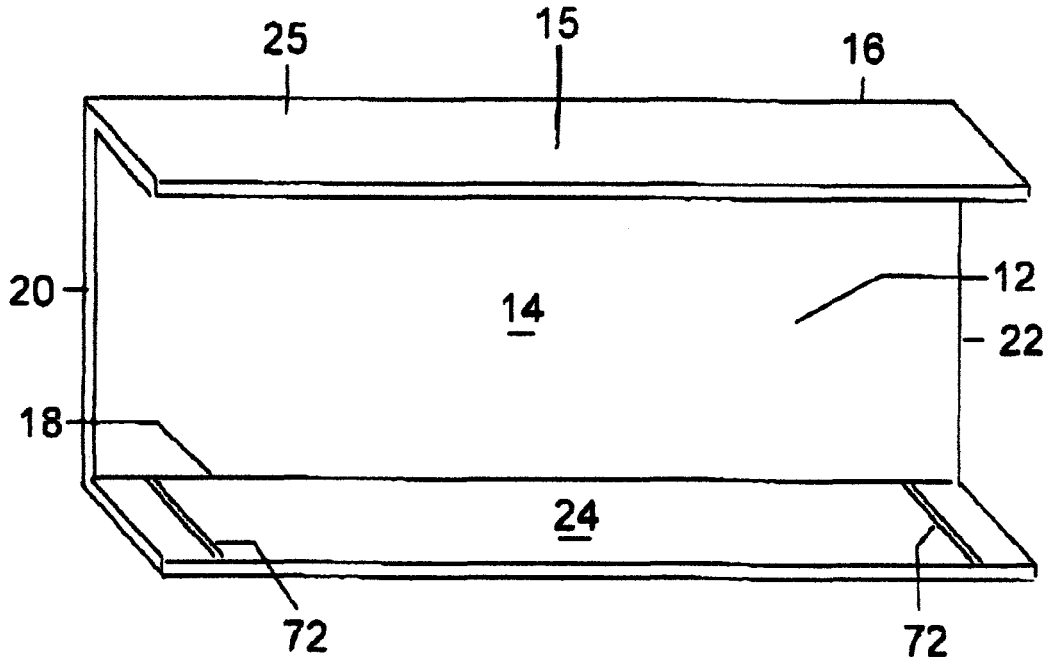
FIG. 7 is a perspective front view of the back plate of the present invention.
Figure 8:
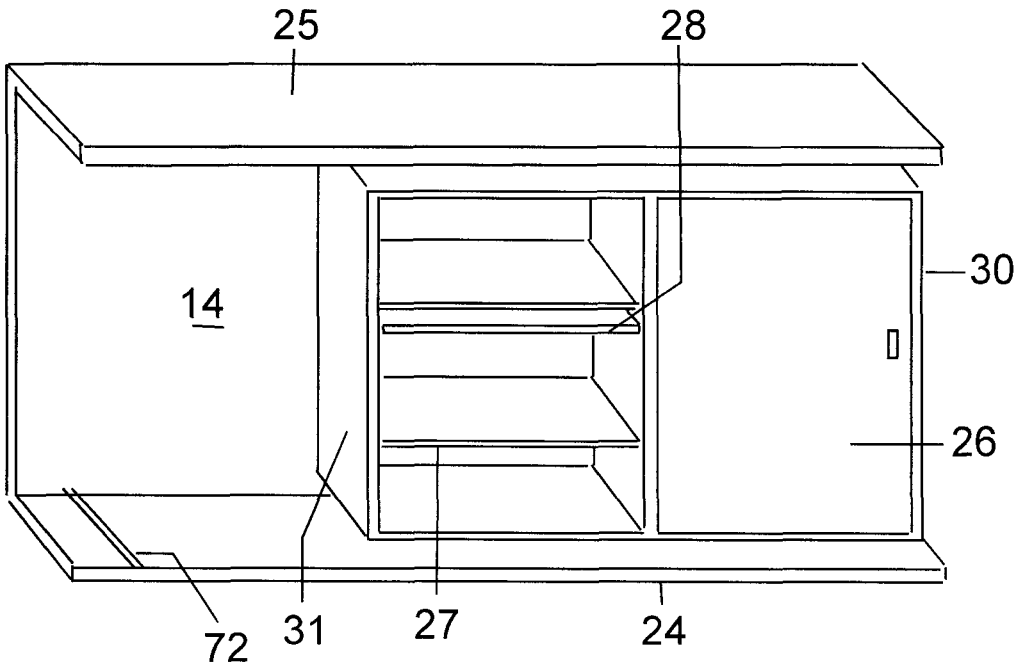
FIG. 8 is a perspective illustration of the back plate with the modular shelving unit shown in FIG. 9 in position.
Figure 9:
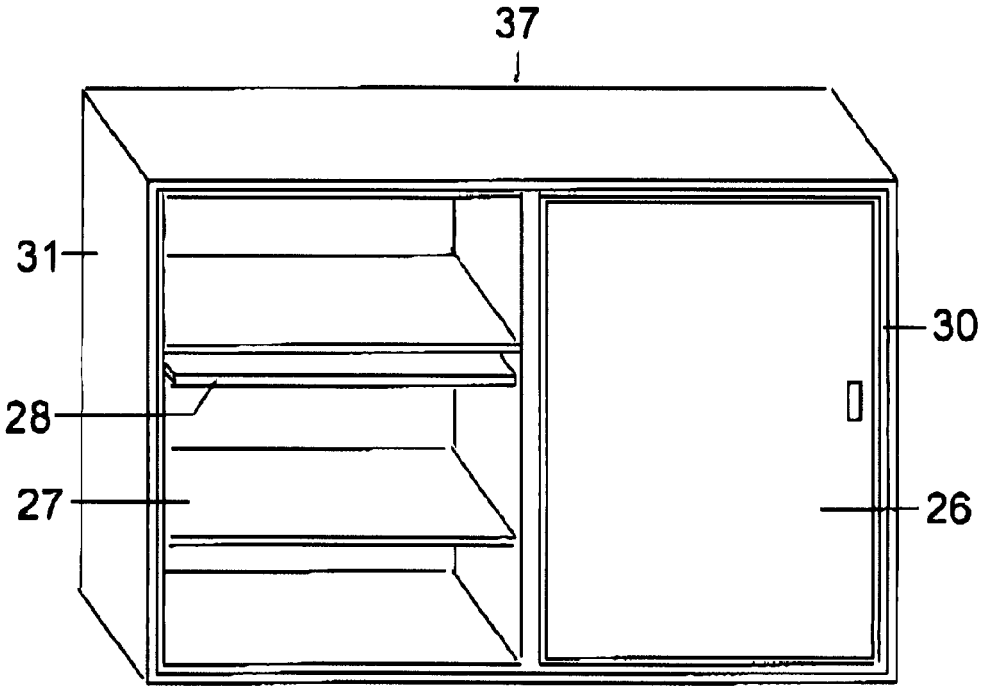
FIG. 9 is a perspective front view of the interchangeable box-shaped modular units of the present invention.
Figure 10:
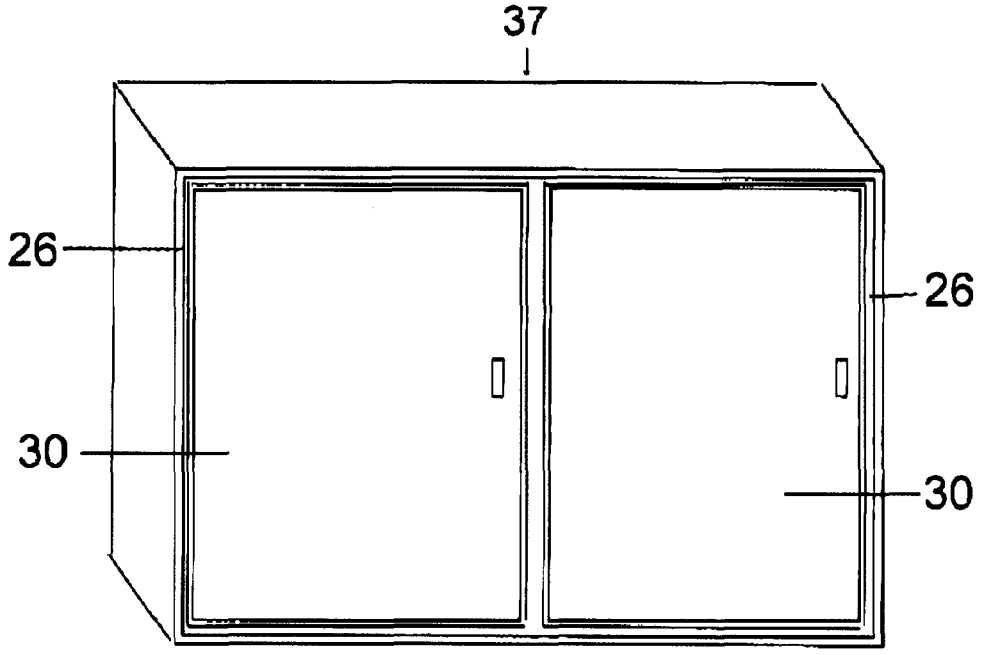
FIG. 10 is a perspective view of an alternate embodiment and configuration of the interchangeable box-shaped modular units.
Figure 11:
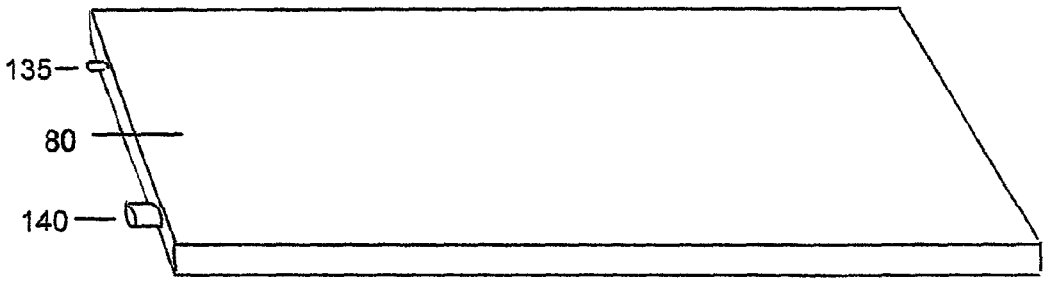
FIG. 11 is a front view of the middle panel with stacking assembly, two laterally extending projections extending from each side of the middle panel.
Figure 12:
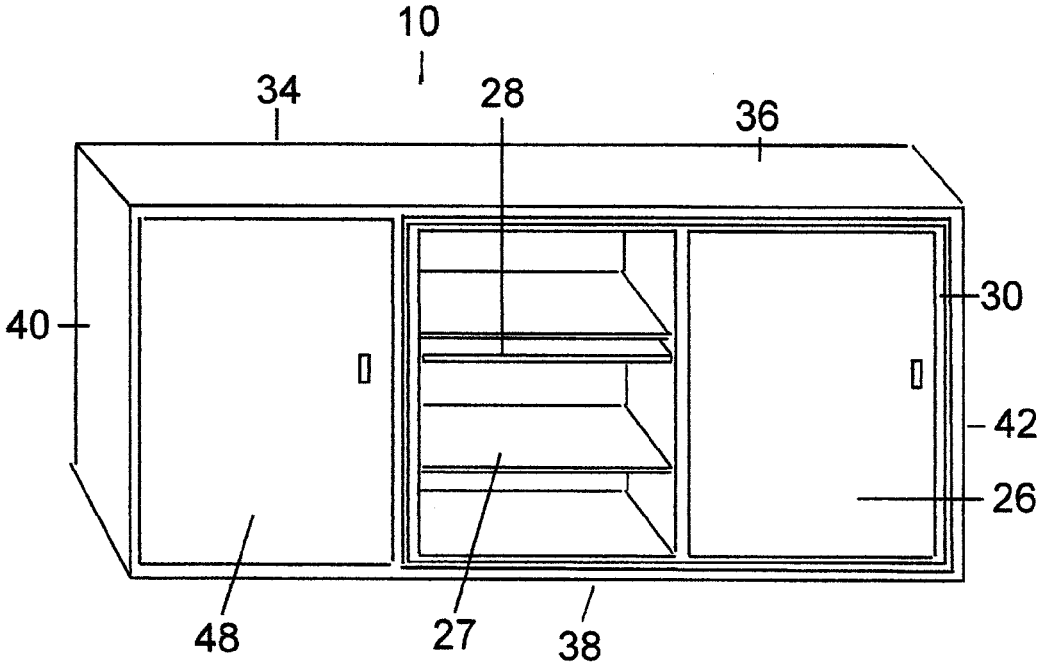
FIG. 12 is a perspective front view of an alternate embodiment of the cabinet of the present invention shown without the back plate.
Figure 13:
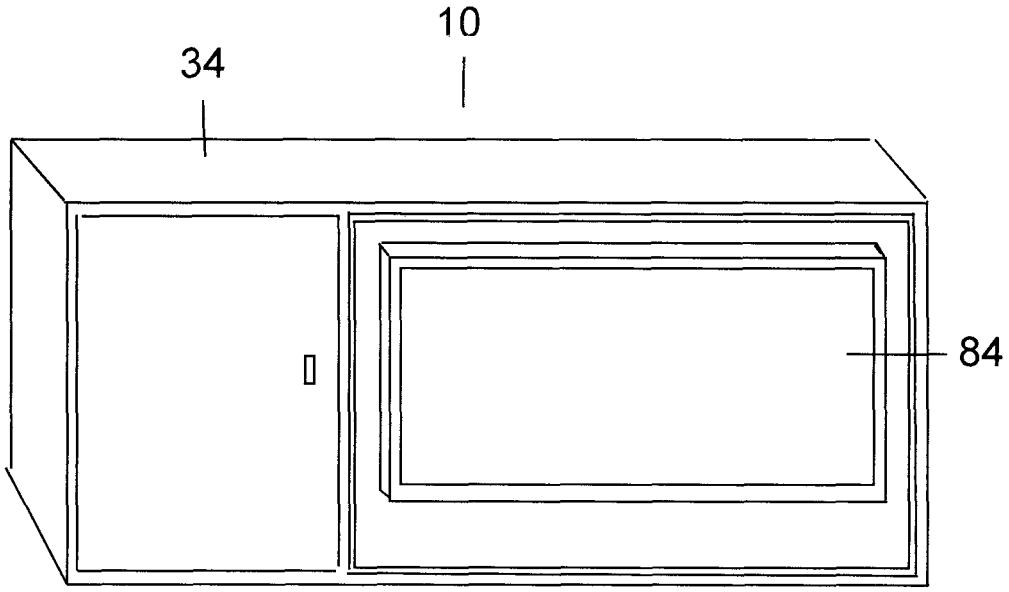
FIG. 13 is a front perspective illustration of an alternate embodiment of the cabinet without including the back plate of the present invention in a vertical orientation engaging a remote item, a television.
Figure 14:
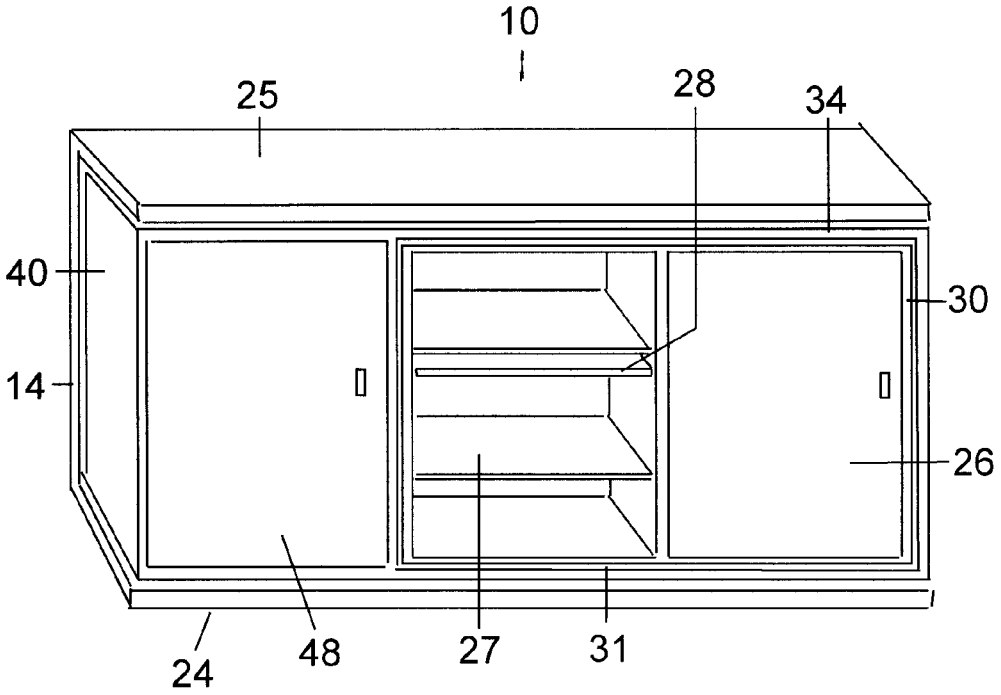
FIG. 14 is a perspective front view of the furniture system with the back plate in a vertical orientation, the front vertical central section of the back plate having the inter-changeable modular shelving assemblies and the box-shaped shelving assemblies, and the cabinet in a vertical orientation and the cabinet positioned upon the foot plate and against the back plate.
Figure 15:
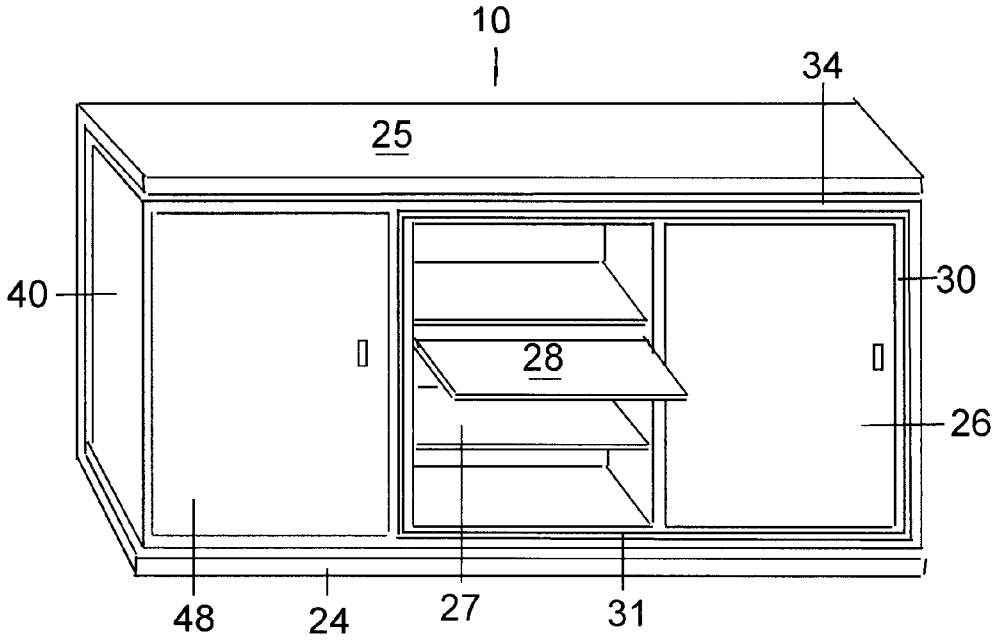
FIG. 15 is a perspective front view as shown in FIG. 14 but shown with the pull out desk and work stations in the secondary position laterally disposed from the shelving assemblies and the box-shaped shelving assemblies.
Figure 16:
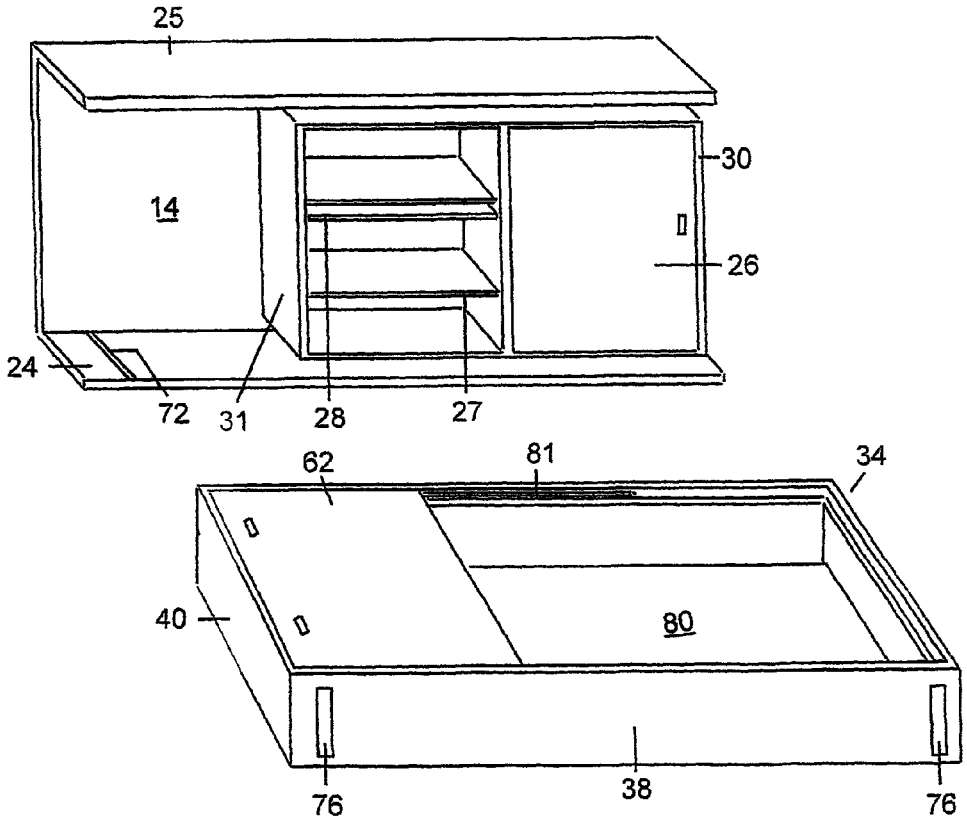
FIG. 16 is a perspective view of the furniture system with the back plate positioned vertically with the modular shelving unit supported by the back plate and showing the cabinet configured for use with a mattress positioned horizontally upon the floor laterally spaced from the foot plate.
Figure 17:
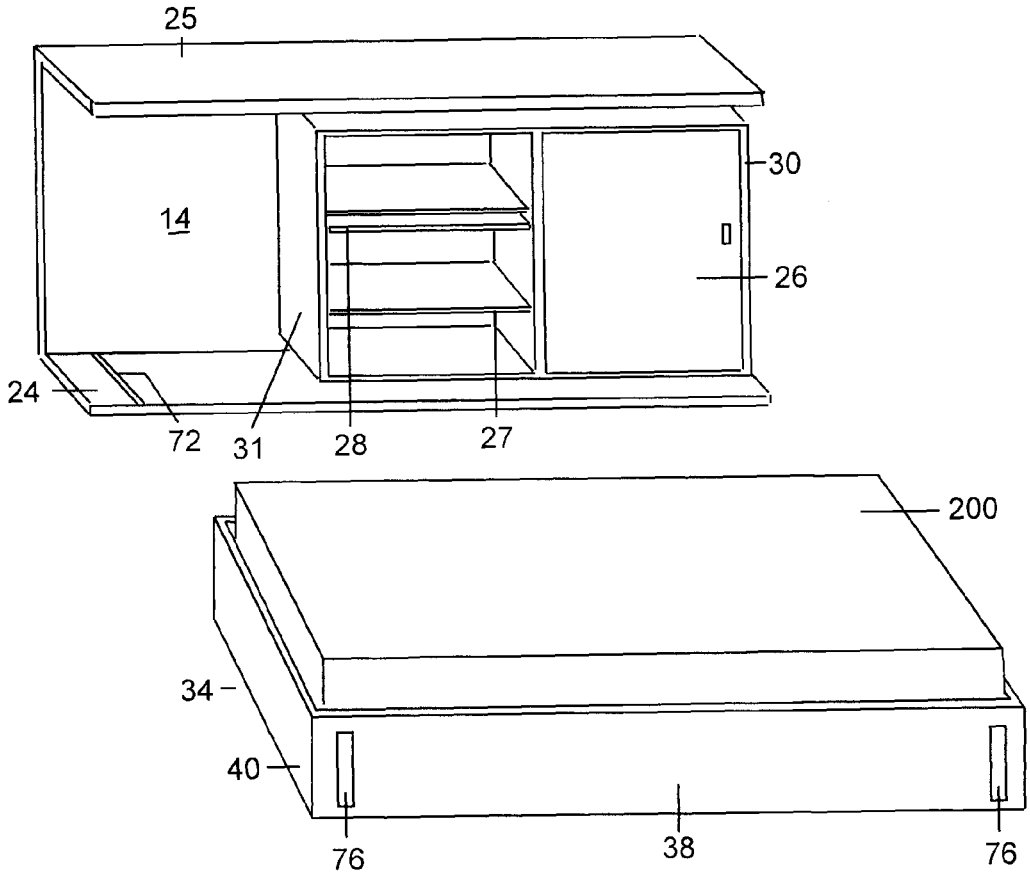
FIG. 17 is a perspective front view of the furniture system similar to FIG. 16 but showing the mattress in place upon the cabinet.
Figure 18:
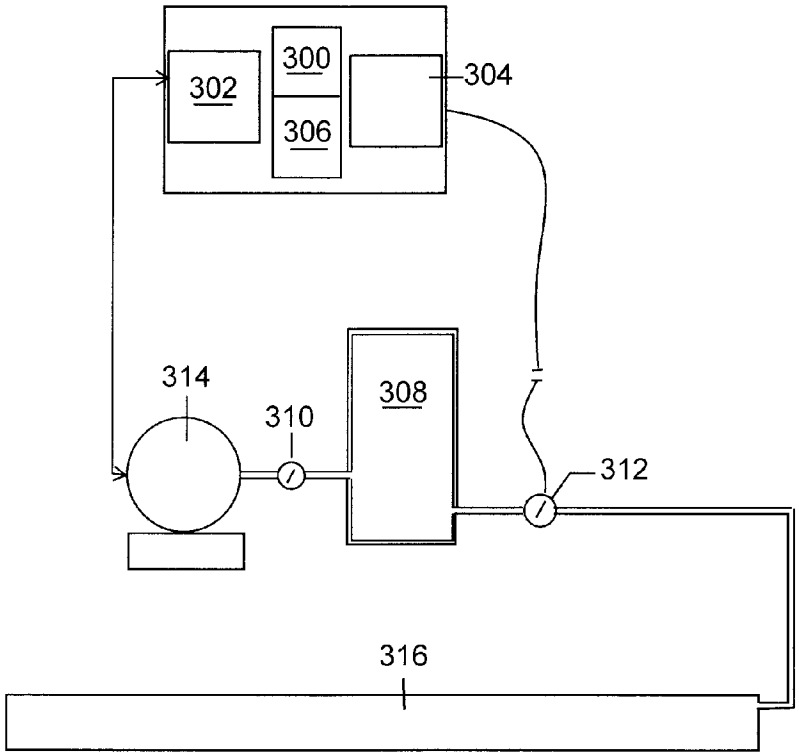
FIG. 18 is a schematic illustration of the computer control module for rapid inflation of the mattress of the alternate embodiment.
Figure 18A:
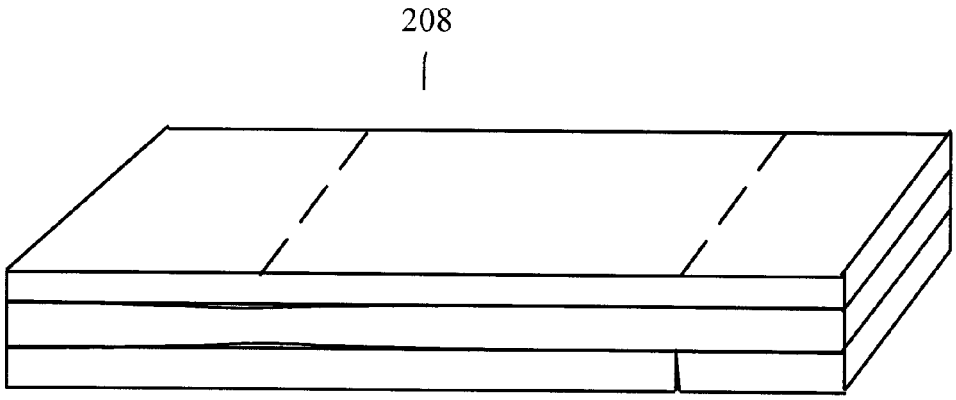
FIGS. 18A and 18B are perspective illustrations of a foldable mattress constructed of a resilient material.
Figure 18B:
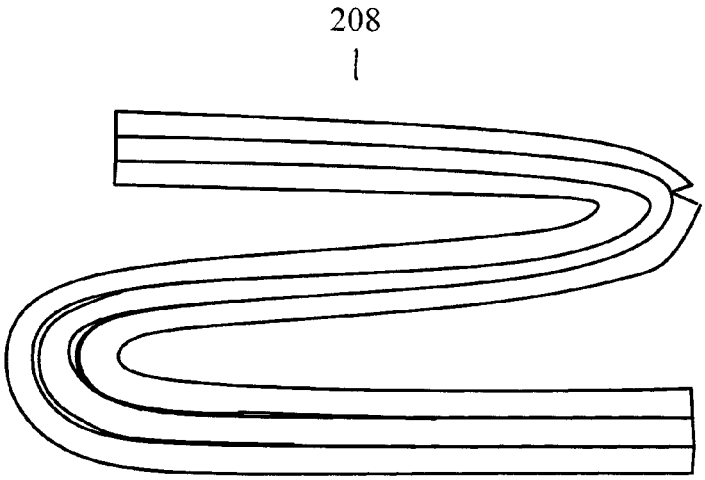
Figure 19:
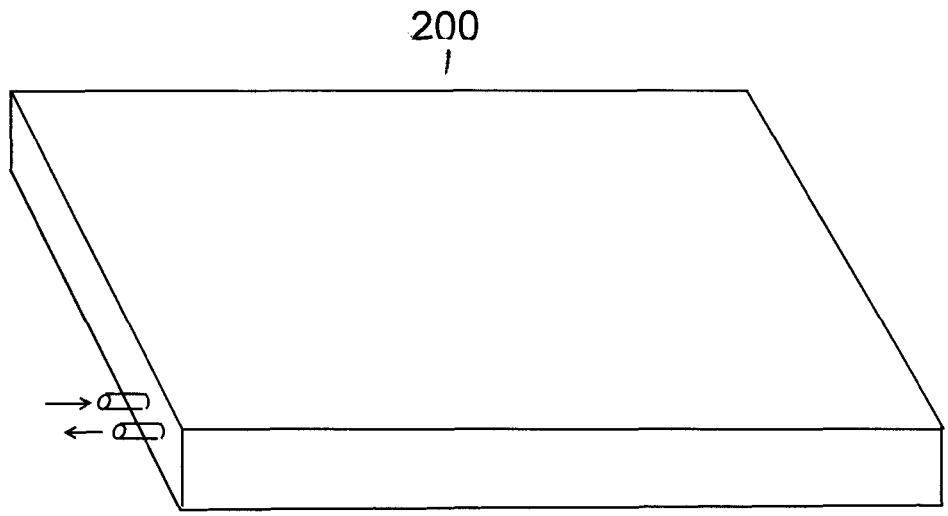
FIG. 19 is a perspective illustration of an inflatable mattress.
Figure 20:
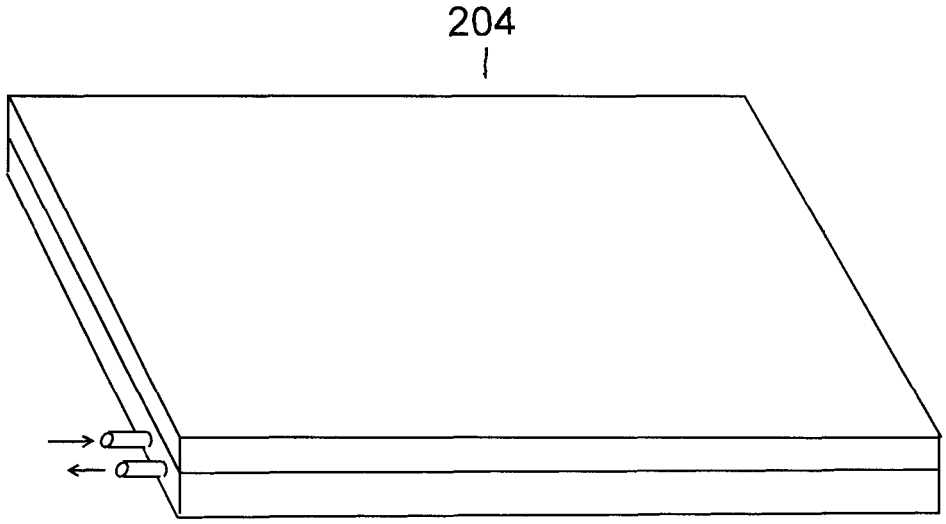
FIG. 20 is a perspective illustration of a combination inflatable and a foldable mattress constructed of a resilient material.

With reference now to the drawings, and in particular to FIG. 1 thereof, the preferred embodiment of the new and improved multi-functional, reconfigurable furniture system embodying the principles and concepts of the present invention and generally designated by the reference numeral 10 will be described.

The present invention, the multi-functional, reconfigurable furniture system 10 is comprised of a plurality of components. Such components in their broadest context include a plurality of inter-changeable box-shaped modular units, a cabinet, a resilient mattress member, and support panels. Such components are individually configured and correlated with respect to each other so as to attain the desired objective.

The present invention is a multi-functional, reconfigurable furniture system 10 that can be converted to a cabinet including a desk and computer work station when needed and alternatively converted to a bed upon necessity.

First provided is a cabinet 34. The cabinet has a horizontal upper plate 36 and a parallel lower plate 38 separated by a height. The cabinet has a vertical left side plate 40 and a parallel right side plate 42 separated by a width. The length and width are generally greater than the width of a resilient mattress member associated with this system. The cabinet has an intermediate plate 44 that is parallel to the vertical left side plate 40 and the parallel right side plate 42. Thus a left central opening 63 is formed between the upper plate, the lower plate, the left side plate and the intermediate plate. Thus also, a right central opening (60) is formed between the upper plate, the lower plate, the right side plate and the intermediate plate.

The right central opening is greater in dimension and generally is double the size of the left central opening. The right central opening receives and engages the inter-changeable modular shelving assemblies 30, the box-shaped shelving assemblies 31 provided with this system, and also other remote items and objects including television and pictures. The inter-changeable modular shelving assemblies 30, the box-shaped shelving assemblies 31, and remote items and objects including television and pictures can be secured to remote structures such as a wall. Or, in the alternative, they can also be secured using the back plate assembly provided with this system.

The left central opening is generally provided with doors in the front and back. The left central opening generally 63 provides housing 48 and storage. The left central opening provides housing for storage of a mattress that is being selected to be used with this system from a selection of resilient mattress members 200, 204, 208.

The cabinet is movable between a horizontal orientation and a vertical orientation. In the horizontal orientation, the cabinet is positioned upon the floor with the upper and lower plates vertically disposed.

In the vertical orientation, the cabinet is positioned upon the bottom plate and, alternatively, lateral to a remote structure including a wall or back plate assembly. Positioning in the vertical orientation is with the intermediate plate separating the inter-changeable modular shelving assemblies 30 and the box-shaped shelving assemblies 31 from the housing 48 and with the upper and lower plates horizontally disposed.

Next provided is a selection of inter-changeable box-shaped modular units (37) comprised of a plurality of selection of interchangeable components including a selection of shelving assemblies (30) and a selection of box-shaped shelving assemblies (31). The modular shelving assemblies and the box-shaped shelving assemblies are further comprised of a selection of components to choose from including at least shelves (27), utility cabinets (26), pull out desks and work stations (28). The inter-changeable box-shaped modular units (37), the shelving assemblies (30) and box-shaped shelving assemblies (31) are provided in a plurality of sizes, combinations and selections. This allows the user to choose the number of components, the type of components, and also the combination and the configuration of the components to meet users' specific needs and preference and the to meet the requirements for replacement and addition of new components at a future time. The inter-changeable box-shaped modular units (37) and shelving assemblies (30) and box-shaped shelving assemblies (31) are secured to remote structures including a wall and alternatively secured to the foot plate. The pull out desks and work stations (28) include a secondary position which is a laterally disposed position from the shelving assemblies (30) and the box-shaped shelving assemblies (31);

Further provided are a selection of a plurality of resilient mattress members. The selection of resilient mattress members includes an inflatable mattress 200, a foldable mattress comprising resilient materials 208, and a combination inflatable and a foldable mattress comprising resilient material 204. The inflatable mattress is adapted to be deflated and inserted into one of the housings. The resilient mattress members are adapted to be folded and inserted into one of the housings when the cabinet is in the vertically orientated position. The mattress is placed upon the support panels 58, 60, 62 of the cabinet when the cabinet is in the horizontal orientation.

The cabinet is provided with similarly configured support panels 58, 60, 62 coupled to the cabinet. The support panels include a lower panel 58, middle panel 60, and an upper panel 62. The lower panel 58 is coupled to the cabinet. The middle panel 60 is provided with a stacking assembly. The stacking assembly includes four laterally extending projections 135, 140 extending from the middle panel. The upper plate 36 and the lower plate 38 are formed with opposed parallel slots 81 for slidably receiving the lateral projections. In this manner, the middle support panel is slidable in a first direction for positioning in a stacked orientation when the cabinet is in the vertical orientation and slidable in a second direction for re-positioning and spanning the opening of the horizontally oriented cabinet.

The upper panels 62 are provided with hinges 70 for folding and stacking the upper panel 62 upon the middle panel when the cabinet is in the vertical orientation. The support panels are re-positionable for spanning the openings when the cabinet is in the horizontal orientation. In this manner, the panels will totally cover the openings and provide full support for a resilient mattress member including an inflated mattress and a foldable mattress.

The bottom plate of the cabinet is provided with receptacle areas 72 for engaging wheels and glides and thus provides mobility for the cabinet.

Further provided is the back plate for receiving and securing inter-changeable modular shelving assemblies 30, the box-shaped shelving assemblies 31, and remote items and objects including television and pictures.

The back plate 14 has a horizontal upper edge 16 and a parallel lower edge 18 separated by a height which is generally greater than the width of a resilient mattress member associated and used with this system. The back plate has a vertical left side edge 20 and a parallel right side edge 22 separated by a width that is generally greater than the length of a resilient mattress member associated and used with this system. The back plate is vertically positionable and securable to a remote structure including a wall of a building. The foot plate 24 is attached to the lower edge of the back plate. The foot plate extends forwardly from the back plate. The width of the foot plate is generally equal to the width of the back plate. The foot plate is provided with tracks 72 for directing and receiving the cabinet 34 into the proper position. The top plate 25 is attached to the upper edge of the back plate. The width of the top plate is generally the width of the back plate. The top plate extends forward from the back plate. The back plate is formed with a front vertical central section 12. The front vertical central section of the back plate 14 is adapted to receive the inter-changeable box-shaped modular units 37 comprising shelving assemblies 30 and the box-shaped shelving assemblies 31. The top surface (15) of the top plate 25 is provided as a counter top for receiving remote objects and items including television, lamps, electronic equipment, and any other appropriate items selected by a user of the system.

In an alternate embodiment of the invention, the system further includes a computer control unit comprising at least a processor 300, a memory 304, a programmer 306, a clock generator 302, a compressor 314, a storage tank 308 for storing gases including air under pressure, and valves 310, 312 upon opening allowing flow of the compressed gas in one direction. The processor and the compressor and the clock generator provide compressed air to be generated and stored at selected periods of time and upon user query and selection. The processor activates the opening of the valve 312 discharging the stored compressed gas including compressed air to inflate the inflatable mattress 316 thus providing rapid inflation of the inflatable mattress.

It should be understood that the furniture and associated mattresses of the system may be fabricated in various sizes, shapes, and functions. The furniture and mattresses have the means to be adapted to include such variations in size, materials, shape, form, function and manner of operation, assembly, and use. In this manner, the system may be configured in a variety of ways to include any number of a selection of inter-changeable box-shaped modular units, shelving assemblies, shelves, utility cabinets, pull out desks, computer work stations, mattresses, television sets, and other electronic devices in any of various sizes and configurations as the user may wish to configure the system for individual functions and tastes. The system meant to be adaptable to change from one configuration to another for use now for one function and again at a later time with different or additional components for another function.

It is within the scope of the invention to modify and engineer the components including the panels to reduce weight and to adapt the system for use with a plurality of sizes of mattresses and beds.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A multi-functional, reconfigurable furniture system (10) for conversion to a cabinet including a desk and computer work station generally during the day and for conversion to a bed upon necessity, the system comprising, in combination:

a selection of inter-changeable box-shaped modular units (37) comprising a plurality of selection shelving assemblies (30) and box-shaped shelving assemblies, the modular shelving assemblies and the box-shaped shelving assemblies further comprising a selection of at least shelves (27), utility cabinets (26), pull out desks and work stations (28), the inter-changeable box-shaped modular units (37) adapted to be combined in plurality of configurations, providing the inter-changeable box-shaped modular units, the shelving assemblies, the box-shaped shelving assemblies (31), shelves (27), utility cabinets (26), pull out desks and work stations (28) as interchangeable components and further providing in a plurality of sizes, combinations, configurations and selections, thus allowing a user to choose specific components and configuration of components for specific requirements, necessities, and preference and further allowing changing and replacing of components at a future time, and the inter-changeable box-shaped modular units (37) and shelving assemblies (30) and box-shaped shelving assemblies (31) positionable and securable to remote structures including a wall, the pull out desks and work stations (28) including a secondary position laterally disposed from the shelving assemblies (30) and the box-shaped shelving assemblies (31);

a cabinet (34) having a horizontal upper plate (36) and a parallel lower plate (38) separated by a height, the cabinet having a vertical left side plate (40) and a parallel right side plate (42) separated by a width, the dimension of the length and width are generally greater than the length and width of one of a plurality of resilient mattress members associated with the system, the cabinet having an intermediate plate (44), a left central opening (63) between the upper plate and the lower plate and between the left side plate and the intermediate plate, a right central opening (80) between the upper plate and the lower plate and between the right side plate and the intermediate plate, the right central opening being greater in dimension and generally double the size of the left central opening;

the right central opening engaging the inter-changeable box-shaped modular units (37), the shelving assemblies (30) and the box-shaped shelving assemblies (31) and remote items and objects including a television and pictures, the left central opening (63) providing a housing (48) with doors, the housing providing storage including the storage of the resilient mattress members (200, 204, 208);

the cabinet being movable between a horizontal orientation and a vertical orientation, the horizontal orientation positioning the cabinet upon a floor with the upper and lower plates vertically disposed, the vertical orientation positioning the cabinet upon the back plate (14) and generally positioning the cabinet laterally to a remote structure including a wall and with the intermediate plate separating the inter-changeable modular shelving assemblies (30) and the box-shaped shelving assemblies (31) from the housing (48) and with the upper and lower plates horizontally disposed;

the plurality of resilient mattress members including an inflatable mattress (200), and a foldable mattress comprising resilient materials (208), and a combination inflatable and a foldable mattress comprising resilient material (204), the inflatable mattress adapted to be deflated, and the resilient mattress members adapted to be folded and inserted into one of the housings when the cabinet is in the vertical orientation and placed upon the cabinet when in the horizontal orientation;

similarly configured support panels (58)(60)(62) coupled to the cabinet, the support panels including a lower panel (58) and a middle panel (60) and an upper panel (62), the lower panel (58) coupled to the cabinet, the middle panel (60) including a stacking assembly having four laterally extending projections (135) (140) extending from the middle panel, the upper plate (36) and the lower plate (38) being formed with opposed parallel slots for slidably receiving lateral projections whereby the middle support panel is slidable in a first direction for positioning in a stacked orientation when in the vertical orientation and slidable in a second direction for re-positioning and spanning the openings; and the upper panel (62) including hinges (70) for folding and stacking the upper panels (62) upon the middle plate when the cabinet is in the vertical orientation, the support panels re-positionable for spanning the left central and right central openings when in the horizontal orientation, whereby the panels will totally cover the left central and right central openings and provide full support for one of the plurality of resilient mattress members, the lower plate (38) including receptacle areas (76) for engaging wheels and glides thus providing the cabinet mobility.

2. The system as set forth in claim 1 and further including a computer control unit comprising at least a processor (300), a memory (304), a programmer (306), a clock generator (302), a compressor (314), a storage tank (308) for storing gases including air under pressure, valves (310, 312) upon opening allowing flow of the compressed gas in one direction, the processor and the compressor and the clock generator providing compressed air to be generated and stored at selected periods of time and upon user query and selection, the processor activating the opening of the valve (312) discharging the stored compressed gas including compressed air to inflate the inflatable mattress (316) thus providing rapid inflation of the inflatable mattress.

3. The system as set forth in claim 1 fabricated in various sizes, shapes and functions and have the means to be adapted to include such variations in size, materials, shape, form, function and manner of operation, assembly and use.

4. A multi-functional, reconfigurable furniture system (1) for conversion to a cabinet including a desk and computer work station generally during the day and for conversion to a bed upon necessity, the system comprising, in combination;

a selection of inter-changeable box-shaped modular units (37) comprising a plurality of selections of components and combination of components including shelving assemblies (30) and box-shaped shelving assemblies (31), the modular shelving assemblies and the box-shaped shelving assemblies further comprising a selection and configuration of components to choose from including at least shelves (27), utility cabinets (26), pull out desks and work stations (28), the inter-changeable box-shaped modular units (37), the shelving assemblies (30) and box-shaped shelving assemblies (31) provided in a plurality of sizes, combinations and selections, thus providing plurality of choices of components and configuration for user's specific needs and preferences and further providing replacing of an existing component and including adding new components at a future time and the inter-changeable box-shaped modular units (37) and shelving assemblies (30) and box-shaped shelving assemblies (31) positionable and securable to remote structures including a wall and a back plate (14) provided with this system, the pull out desks and work stations (28) including a secondary position laterally disposed from the shelving assemblies (30) and the box-shaped shelving assemblies (31);

the back plate (14) having a horizontal upper edge (16) and a parallel lower edge (18) separated by a height which is generally greater than the width of a resilient mattress member associated with the system, the back plate having a vertical left side edge (20) and a parallel right side edge (22) separated by a width that is generally greater than the length of resilient mattress member associated with the system, the back plate being vertically positionable and securable to a remote structure including a wall;

a foot plate (24) attached to the lower edge of the back plate, the foot plate extending forwardly from the back plate, the foot plate generally having a width equal to the width of the back plate, the foot plate including tracks (72) for directing and receiving a cabinet (34);

a top plate (25) attached to the upper edge of the back plate, the top plate generally having a width equal to the width of the back plate, the top plate extending forwardly from the back plate, the back plate being formed with a front vertical central section (12), the front vertical central section of the back plate (14) being adapted to receive the inter-changeable box-shaped modular units (37) the shelving assemblies (30) and the box-shaped shelving assemblies (31), the top surface (15) of the top plate (25) providing a counter top for displaying and a working surface for receiving remote objects and items including television, lamps, electronic equipment, and items selected by the user of the system;

the cabinet (34) having a horizontal upper plate (36) and a parallel lower plate (38) separated by a height, the cabinet having a vertical left side plate (40) and a parallel right side plate (42) separated by a width, the dimension of the length and width are generally greater than the length and width of a resilient mattress member associated with the system, the cabinet having an intermediate plate (44), a left central opening (63) between the upper plate and the lower plate and between the left side plate and the intermediate plate, a right central opening (80) between the upper plate and the lower plate and between the right side plate and the intermediate plate, the overall dimension of the left central opening generally being a half of the right central opening, the right central opening receiving and engaging the inter-changeable box-shaped modular units (37), the shelving assemblies (30) and the box-shaped shelving assemblies (31) and remote items and objects including a television, pictures and shelving;

the left central opening (63) providing a housing (48) with doors, the housing providing storage including the storage for the plurality of resilient mattress members (200, 204, 208);

the cabinet being movable between a horizontal orientation and a vertical orientation, the horizontal orientation positioning the cabinet (34) upon a floor laterally spaced from the foot plate with the upper and lower plates vertically disposed, the vertical orientation positioning the cabinet upon the foot plate and against the back plate and with the intermediate plate separating the remote items and objects including television and pictures and inter-changeable box-shaped modular units (37) comprising shelving assemblies (30) and box-shaped shelving assemblies (31) from the housing (48) and with the upper and lower plates horizontally disposed;

the plurality of resilient mattress members (90) including an inflatable mattress (200), a foldable mattress comprising resilient materials (208) and a combination inflatable and foldable mattress comprising resilient material (204), the inflatable mattress adapted to be deflated and the resilient mattress members adapted folded and be inserted into one of the housings when the cabinet is in the vertical orientation and placed upon the cabinet when in the horizontal orientation;

similarly configured support panels (58)(60)(62) coupled to the cabinet, the support panels including a lower panel (58) and a middle panel (60) and an upper panels (62), the lower panel (58) being coupled to the cabinet, the middle panel (60) including a stacking assembly having four laterally extending projections (135) (140) extending from the middle panel, the upper plate (36) and the lower plate (38) being formed with opposed parallel slots for slidably receiving lateral projections;

whereby the middle support panel is slidable in a first direction for positioning in a stacked orientation when in the vertical orientation and slidable in a second direction for re-positioning and spanning the openings; and the upper panel (62) including hinges (70) for folding and stacking the upper panel (62) upon the middle panel when the cabinet is in the vertical orientation, the support panels re-positionable for spanning the openings when in the horizontal orientation, whereby the panels will totally cover the openings and provide full support for the resilient mattress member including the inflated mattress and foldable mattress, the bottom plate including receptacle (76) areas for engaging wheels and glides thus providing the cabinet mobility.

5. A multi-functional, reconfigurable furniture system for conversion to a cabinet including a desk and computer work station generally during the day and for conversion to a bed upon necessity, the system comprising, in combination;

a cabinet;

a selection of inter-changeable box-shaped modular units comprising of plurality of selection of modular shelving assemblies and box-shaped shelving assemblies, the shelving assemblies and the box-shaped shelving assemblies further comprising at least shelves, utility cabinets, pull out desks and work stations, the inter-changeable box-shaped modular units, the shelving assemblies and box-shaped shelving assemblies, the shelves, utility cabinets, pull out desks and work stations provided in a plurality of selections including sizes, shapes, utility, functionality, combinations and configuration, thus providing a choice of a specific component and configuration of components for a specific requirement, necessities and preference and further allowing changing and replacing of components at a future time and the inter-changeable box-shaped modular units and shelving assemblies and box-shaped shelving assemblies positionable and securable to remote structures including a wall and a back a back plate provided with this system, the pull out desks and work stations including a secondary position laterally disposed from the shelving assemblies and the box-shaped shelving assemblies;

the back plate having a horizontal upper edge and a parallel lower edge separated by a height which is generally greater than the width of one of a plurality of resilient mattress members associated with the system, the back plate having a vertical left side edge and a parallel right side edge separated by a width that is generally greater than the length of resilient mattress member associated with the system, the back plate being vertically positionable and securable to a remote structure including a wall;

a foot plate attached to the lower edge of the back plate, the foot plate extending forwardly from the back plate, the foot plate generally having a width equal to the width of the back plate, the foot plate including tracks for directing and receiving the cabinet;

a top plate attached to the upper edge of the back plate, the top plate generally having a width equal to the width of the back plate, the top plate extending forwardly from the back plate, the back plate being formed with a front vertical central section, the front vertical central section of the back plate being adapted to receive the inter-changeable box-shaped modular units the shelving assemblies and the box-shaped shelving assemblies, the top surface of the top plate providing a counter top for displaying and a working surface for receiving remote objects and items including television, lamps, electronic equipment, and items selected by the user of the system;

the cabinet having a horizontal upper plate and a parallel lower plate separated by a height, the cabinet having a vertical left side plate and a parallel right side plate separated by a width, the dimension of the length and width are generally greater than the length and width of a resilient mattress member associated with the system, the cabinet having an intermediate plate, a left central opening between the upper plate and the lower plate and between the left side plate and the intermediate plate, a right central opening between the upper plate and the lower plate and between the right side plate and the intermediate plate, the overall dimension of the left central opening generally being a half of the right central opening, the right central opening receiving and engaging the inter-changeable box-shaped modular units, the shelving assemblies and the box-shaped shelving assemblies and remote items and objects including a television, pictures and shelving;

the left central opening providing a housing with doors, the left central housing providing storage including the storage for the resilient mattress members;

the cabinet being movable between a horizontal orientation and a vertical orientation, the horizontal orientation positioning the cabinet upon a floor laterally spaced from the foot plate with the upper and lower plates vertically disposed, the vertical orientation positioning the cabinet upon the foot plate and against the back plate and with the intermediate plate separating the remote items and objects including television and pictures and inter-changeable box-shaped modular units comprising shelving assemblies and box-shaped shelving assemblies from the housing and with the upper and lower plates horizontally disposed;

the plurality of resilient mattress members including an inflatable mattress, a foldable mattress comprising resilient materials and a combination inflatable and foldable mattress comprising resilient material, the inflatable mattress adapted to be deflated and the resilient mattress members adapted folded and be inserted into one of the housings when the cabinet is in the vertical orientation and placed upon the cabinet when in the horizontal orientation;

similarly configured support panels coupled to the cabinet, the support panels including a lower panel and a middle panel and an upper panels, the lower panel being coupled to the cabinet, the middle panel including a stacking assembly having four laterally extending projections extending from the middle panel, the upper plate and the lower plate being formed with opposed parallel slots for slidably receiving lateral projections;

whereby the middle support panel is slidable in a first direction for positioning in a stacked orientation when in the vertical orientation and slidable in a second direction for re-positioning and spanning the openings; and the upper panel including hinges for folding and stacking the upper panel upon the middle panel when the cabinet is in the vertical orientation, the support panels re-positionable for spanning the openings when in the horizontal orientation, whereby the panels will totally cover the openings and provide full support for the resilient mattress member including the inflated mattress and foldable mattress, the bottom plate including receptacle areas for engaging wheels and glides thus providing the cabinet mobility.

* * * * *